US006176949B1

(12) United States Patent
Thomas et al.

(10) Patent No.: US 6,176,949 B1
(45) Date of Patent: Jan. 23, 2001

(54) TITANIUM ALUMINIDE WHICH CAN BE USED AT HIGH TEMPERATURE

(75) Inventors: Marc Thomas, Le Plessis Robinson; Michel Marty, Buc; Shigehisa Naka, Jouy en Josas, all of (FR)

(73) Assignee: Onera (Office National D'Etudes et de Recherches Aerospatiales), Chatillon (FR)

( * ) Notice: Under 35 U.S.C. 154(b), the term of this patent shall be extended for 0 days.

(21) Appl. No.: 09/034,496

(22) Filed: Mar. 4, 1998

(30) Foreign Application Priority Data

Mar. 5, 1997 (FR) ..... 97 02625

(51) Int. Cl.[7] ..... C22C 1/18
(52) U.S. Cl. ..... 148/671; 148/421
(58) Field of Search ..... 148/421, 671; 420/418, 421

(56) References Cited

U.S. PATENT DOCUMENTS 4,292,077 * 9/1981 Blackburn et al. .

FOREIGN PATENT DOCUMENTS

| | | |
|---|---|---|
| 0 304 530 A1 | 3/1989 | (EP) . |
| 0 388 527 A1 | 9/1990 | (EP) . |
| 0 539 152 A1 | 4/1993 | (EP) . |
| 0 293 689 | 4/1996 | (EP) . |
| 2462484 | 2/1981 | (FR) . |
| 2293832 A2 | 12/1988 | (GB) . |
| WO89 01052 | 2/1989 | (WO) . |

* cited by examiner

*Primary Examiner*—John Sheehan
(74) *Attorney, Agent, or Firm*—Hoffmann & Baron, LLP

(57) ABSTRACT

Alloy of the $Ti_2AlX$ type composed at least essentially of the elements Ti, Al, Nb, Ta and Mo and in which the relative amounts as atoms of said elements and of silicon are substantially within the following intervals:

| | |
|---|---|
| Al: | 20 to 25% |
| Nb: | 10 to 15% |
| Ta: | 1.4 to 5% |
| Mo: | 2 to 4% |
| Ti: | remainder to 100%. |

This alloy exhibits properties superior to those of the known titanium alloys.

7 Claims, 2 Drawing Sheets

TITANIUM ALUMINIDE WHICH CAN BE USED AT HIGH TEMPERATURE

The invention related to the alloys predominantly formed of titanium and aluminum commonly known as titanium aluminides.

Titanium alloys are widely used in gas turbine engines but their applications remain limited because of the temperatures of use, which must not exceed 600° C. because, beyond this temperature, their mechanical strength rapidly decreases. During the last 20 years, a number of research studies have had the objective of developing titanium alloys which can be used at high temperatures by virtue of an ordered structure which confers increased strength on them. These new alloys, known as titanium aluminides, are mainly of the $Ti_3Al$ type (ordered $\alpha_2$ phase) and of the TiAl type (ordered $\gamma$ phase). Another ambition of these research studies was to be able also to at least partially replace nickel superalloys, which would be reflected by a large reduction in weight of the engines for the parts used at temperatures beyond which titanium alloys can be used. The main applications targeted by these new alloys relate to the HP compressor in turbomachines. Moreover, by being able to use a higher temperature, the compressor can operate with a better output, which has a favorable effect on lowering the specific consumption.

Studies have been carried out in particular on titanium aluminides of the $Ti_3Al$ type, characterized by a two-phase $\alpha_2$ (ordered hexagonal)+$\beta$ (cubic) structure. In these alloys, the aluminum has a tendency to stabilize the $\alpha_2$ phase, whereas other elements which may be present, in particular niobium, vanadium, molybdenum and tantalum, have a tendency to stabilize the $\beta$ phase.

U.S. Pat. No. 4,292,077 studies the influence of the composition of Ti—Al—Nb ternary alloys on their characteristics of use and provides an alloy, known as $\alpha_2$, containing 24% aluminum and 11% niobium (Ti—24Al—11Nb according to the notation used in the continuation; all the concentrations are given here as atoms, except when otherwise indicated) as offering the best compromise between high-temperature creep strength, favored by aluminum, and ductility, favored by niobium. According to the inventors of the abovementioned patent, niobium can be replaced by vanadium to the level of 4%, which makes it possible to reduce the weight of the alloys while retaining the same standard of mechanical properties, indeed even while improving it.

Provision has also been made to improve the strength/ductility compromise by introducing both molybdenum and vanadium, the first of these constituents increasing both the tensile strength and the creep strength in comparison with the $\alpha_2$ alloy and the second making it possible to retain the ductility and to reduce the weight of the alloy. Thus U.S. Pat. No. 4,716,020 defines an alloy, known as Super $\alpha_2$, containing 25% aluminum, 10% niobium, 3% vanadium and 1% molybdenum. This alloy, however, exhibits the major disadvantage of a low ultimate tensile stress. In addition, it is characterized by some structural instabilities which makes it lose its ductility when it is subjected for several hundred hours to a temperature within the range 565–675° C. U.S. Pat. No. 4,788,035 provides for reducing the amount of niobium and for introducing tantalum, in particular with the composition Ti—23Al—7Ta—3Nb—IV, which results in a particularly advantageous creep strength. However, no indication is given as regards the ductility at ambient temperature.

None of the above alloys possesses a combination of hot and cold strength and ductility, and of creep strength, sufficient to enable it to be used in gas turbines.

U.S. Pat. No. 5,032,357 described alloys having a niobium content of greater than 18% and possessing an orthorhombic phase, known as O, an ordered phase corresponding to the intermetallic $Ti_2AlNb$ compounds. In this phase, a crystallographic site is occupied exclusively by Nb, instead of being occupied without distinction by Ti and by Nb in the $\alpha_2$ phase.

The O phase was observed over a wide range of atomic compositions from Ti—25Al—12.5Nb to Ti—25Al—30Nb. For lower Al contents (between 20 and 24%), the alloys are two-phase $\beta_0$+O and possess similar microstructures to those of the $\beta+\alpha_2$ alloys, although they are generally finer because of the slower kinetics of transformation. The $\beta_0$ phase corresponds here to the ordered structure of B2 type of the $\beta$ phase. The orthorhombic alloys are thus divided into two groups: the O single-phase alloys, which are similar to the composition $Ti_2AlNb$, and the $\beta_0$+O two-phase alloys, which are substoichiometric in aluminum. The category of the O single-phase alloys, such as the Ti—24.5Al—23.5Nb alloy, is characterized by an increased creep strength. The category of the $\beta_0$+O two-phase alloys, such as the Ti—22Al—27Nb alloy, is illustrated more particularly by their high strength, while retaining a reasonable ductility. Consequently, depending on a criterion of priority to creep or of priority to mechanical strength, the use of the two alloys Ti—24.5Al—23.5Nb (O) and Ti—22Al—27Nb ($\beta_0$+O) has been recommended.

U.S. Pat. No. 5,205,984 furthermore provides for the partial substitution of the element vanadium by niobium for this novel category of orthorhombic alloys. The quaternary alloys obtained do not seem to be of particular advantage in comparison with the ternary alloys, taking into account in particular the known harmful influence, moreover, of vanadium on the oxidation resistance.

It turns out that the ternary orthorhombic alloys exhibit physical and mechanical characteristics which can limit their industrial development, such as a fairly high density (5.3) because of a high niobium content. In addition, these alloys undergo a pronounced loss in strength on prolonged annealing. An increase in the annealing time from 1 to 4 hours at 815° C. or else the use of a second annealing of 100 hours at 760° C. causes a loss of 300 MPa in the elastic limit of the Ti—22Al—27Nb alloy. Finally, the compromise is difficult to find between the cold ductility and the creep strength, whether by acting on the composition of the alloy or on the heat treatments to be applied to it.

One aim of the present invention is to produce titanium aluminides which possess specific tensile and creep strengths which are greater than those of the above alloys of the $Ti_3Al$ and $Ti_2AlNb$ categories, which can be used at temperatures of greater than 650° C. and which have a satisfactory ductility at 20° C.

Another aim of the present invention is to provide an alloy of the $Ti_2AlX$ type which possesses an excellent combination of tensile strength and creep strength up to 650° C. and which, at the same time, exhibits a high deformability at 20° C. to enable it to be manufactured and used.

These aims are achieved, on the one hand, by virtue of narrow ranges of alloy compositions and, on the other hand, by virtue of a transformation process which makes it possible to take advantage of these alloy compositions.

The invention is targeted in particular at an alloy of the $Ti_2AlX$ type composed at least essentially of the elements Ti, Al, Nb, Ta and Mo and in which the relative amounts as atoms of said elements and of silicon are substantially within the following intervals:

Al: 20 to 25%

Nb: 10 to 14%

Ta: 1.4 to 5%

Mo: 2 to 4%

Si: 0 to 0.5%

Ti: remainder to 100%.

In addition to the elements Ti, Al, Nb, Ta, Mo and Si, the alloy according to the invention can contain other elements, such as Fe, at low concentrations, preferably of less than 1%.

Optional characteristics of the alloy according to the invention, complementary or alternative, are stated hereinbelow:

It contains 21 to 32% of niobium equivalent as atoms. The niobium equivalent is obtained by adding, to the amount of niobium, the amounts of the other elements of the alloy favoring the β phase, modified by a coefficient corresponding to the β-gen power of the elements under consideration in comparison with niobium. Thus, as Ta and Mo have respectively β-gen powers equal to and triple that of niobium, 1% of Ta and 1% of Mo respectively represent 1% and 3% of niobium equivalent.

Said relative amounts are substantially within the following intervals:

| | |
|---|---|
| Al: | 21 to 23% |
| Nb: | 12 to 14% |
| Ta: | 4 to 5% |
| Mo: | 3% |
| Ti: | remainder to 100%. |

Said relative amounts are substantially as follows:

| | |
|---|---|
| Al: | 22% |
| Nb: | 13% |
| Ta: | 5% |
| Mo: | 3% |
| Ti: | 57%. |

Another subject of the invention is a process for the transformation of an alloy as defined above comprising an extrusion treatment at a temperature suitable for the production of a creep-resistant single-phase structure, followed by an annealing for at least four hours in the interval from 800 to 920° C., in order to produce a stable $\beta_0$+O two-phase structure favorable to the ductility. It should be pointed out that an extrusion operation creates an adiabatic heating of approximately 50° C. Thus, the temperature suitable for the production of the single-phase structure is at least equal to the transus temperature of the alloy lowered by approximately 50° C. corresponding to this adiabatic heating.

In the process according to the invention, the extrusion treatment can be preceded by an isothermal forging treatment at a temperature below the β-transus temperature of the alloy.

The invention is further targeted at a turbo-machine component made from an alloy as defined above, if appropriate transformed by the process as defined above.

The characteristics and advantages of the invention will be described in more detail in the following description, with reference to the appended drawings, in which FIGS. 1 and 2 are diagrams comparing the properties of the alloys according to the invention with those of known alloys.

The examples below comprise the preparation of alloys cast by arc-melting or by levitation in the form of small ingots weighing 200 g or of ingots weighing 1.6 kg.

EXAMPLE 1

This example relates to the known alloy Ti—22Al—27Nb mentioned above and is targeted at evaluating the effects of different types of thermomechanical treatments.

For this alloy, the transus was determined metallographically at 1040° C. Two types of thermomechanical treatments were compared on this alloy. The first comprises an isothermal forging at a temperature of 980° C. with a degree of reduction in thickness of 85%. The second comprises an extrusion at a temperature of 1100° C. with an extrusion ratio of 1:9. In the case of the isothermal forging, use is made of the conditions for heat treatments recommended in the literature, namely, firstly, a solution treatment in the B2 single-phase range, in this instance at 1065° C., followed by moderate air cooling at the rate of 9° C./s. The subsequent double annealing makes it possible to obtain a fine decomposition of the matrix according to the transformation $\beta_0 \rightarrow \beta_0$+O. It comprises an annealing for four hours at 870° C., followed by an annealing for 100 hours at 650° C. This same double annealing was used after extrusion in order to compare the two transformation sequences for the same $\beta_0 \rightarrow \beta_0$+O phase transformation state.

The results of mechanical tensile tests at 20° C. and at 650° C., namely the stress in MPa for an elongation of 0.2%, the maximum stress in MPa and the total elongation in %, are given in Table 1. The extrusion transformation sequence (second and fifth rows in the table) results in mechanical properties which are substantially superior to those of the isothermal-forging transformation sequence. While the respective elastic limits at 20° C. and 650° C. are relatively close for the two transformation sequences, which accords well with an equivalent fineness of the microstructure, on the other hand the ductility is as disappointing after forging as it is high after extrusion.

TABLE 1

| Ex. | Alloy | Annealing | Temperature (° C.) | $S_{0.2\%}$ (MPa) | $S_{MAX}$ (MPa) | $E_{TOT}$ (%) |
|---|---|---|---|---|---|---|
| 1 | Ti-22A1-27Nb forged | 4 h 870° C. + 100 h 650° C. | 20 | 932 | 959 | 0.67 |
| | Ti-22A1-27Nb extruded | 4 h 870° C. + 100 h 650° C. | 20 | 995 | 1130 | 9.04 |
| | Ti-22A1-27Nb forged extruded | 150 h 760° C. | 20 | 976 | 1079 | 5.1 |
| | Ti-22A1-27Nb forged | 4 h 870° C. + 100 h 650° C. | 650 | 729 | 827 | 3.96 |
| | Ti-22A1-27Nb extruded | 4 h 870° C. + 100 h 650° C. | 650 | 740 | 845 | 8.43 |
| | Ti-22A1-27Nb | 50 h 760° C. + 100 h 650° C. | 650 | 800 | 945 | 10.7 |
| 2 | Ti-21A1-21Nb | none | 20 | 1241 | 1316 | 2.35 |
| | Ti-21A1-21Nb | 48 h 800° C. | 20 | 1017 | 1225 | 8.59 |
| | Ti-21A1-21Nb | 48 h 800° C. | 650 | 718 | 825 | 6.61 |
| 3 | Ti-27A1-21Nb | 48 h 800° C. | 20 | 755 | 810 | 0.7 |
| | Ti-27A1-21Nb | 48 h 800° C. | 650 | 622 | 766 | 4.43 |
| 4 | Ti-24A1-21Nb | 48 h 800° C. | 20 | 886 | 1017 | 4.64 |
| | Ti-24A1-11Nb-3Mo-1Ta | 48 h 800° C. | 20 | 1334 | 1436 | 1.86 |

TABLE 1-continued

| Ex. | Alloy | Annealing | Temperature (° C.) | $S_{0.2\%}$ (MPa) | $S_{MAX}$ (MPa) | $E_{TOT}$ (%) |
|---|---|---|---|---|---|---|
| | Ti-24A1-21Nb | 48 h 800° C. | 650 | 670 | 795 | 5.52 |
| | Ti-24A1-11Nb-3Mo-1Ta | 48 h 800° C. | 650 | 1076 | 1137 | 0.98 |
| 5 | Ti-22A1-11Nb-3Mo-1Ta | 48 h 800° C. | 20 | 1275 | 1362 | 1.4 |
| | Ti-22A1-11Nb-3Mo-1Ta | 48 h 800° C. | 650 | 884 | 967 | 2.54 |
| 6 | Ti-22A1-13Nb-5Ta-3Mo | 48 h 800° C. | 20 | 1294 | 1443 | 3.69 |
| | Ti-22A1-13Nb-5Ta-3Mo | 48 h 800° C. | 650 | 1001 | 1053 | 1.63 |
| 7 | Ti-22A1-13Nb-5Ta-3Mo (extrusion ratio 1:5) | | 20 | 1243 | 1390 | 3.82 |
| | Ti-22A1-13Nb-5Ta-3Mo (extrusion ratio 1:16) | | 20 | 1294 | 1443 | 3.69 |
| | Ti-22A1-13Nb-5Ta-3Mo (extrusion ratio 1:35) | | 20 | 1303 | 1411 | 2.11 |
| 8 | Ti-22A1-13Nb-5Ta-3Mo (T of extrusion 1100° C.) | | 20 | 1303 | 1411 | 2.11 |
| | Ti-22A1-13Nb-5Ta-3Mo (T of extrusion 980° C.) | | 20 | 1279 | 1461 | 7.65 |
| | Ti-22A1-13Nb-5Ta-3Mo (T of extrusion 1100° C.) | | 650 | 1031 | 1111 | 3.51 |
| | Ti-22A1-13Nb-5Ta-3Mo (T of extrusion 980° C.) | | 650 | 1004 | 1087 | 2.82 |
| 9 | Ti-22A1-14Nb-5Ta-2Mo | 48 h 800° C. | 20 | 1239 | 1408 | 3.79 |
| | Ti-22A1-13Nb-5Ta-3Mo | 48 h 800° C. | 20 | 1303 | 1411 | 2.11 |
| | Ti-22A1-12Nb-5Ta-4Mo | 48 h 800° C. | 20 | 1315 | 1444 | 3 |
| | Ti-22A1-14Nb-5Ta-2Mo | 48 h 800° C. | 650 | 958 | 1042 | 4.1 |
| | Ti-22A1-13Nb-5Ta-3Mo | 48 h 800° C. | 650 | 1031 | 1111 | 3.51 |
| | Ti-22A1-12Nb-5Ta-4Mo | 48 h 800° C. | 650 | 1037 | 1092 | 2.05 |
| 10 | Ti-22A1-13Nb-5Ta-3Mo | 48 h 800° C. | 20 | 1303 | 1411 | 2.11 |
| | Ti-22A1-13Nb-5Ta-3Mo | 24 h 815° C. + 100 h 760° C. | 20 | 1284 | 1457 | 3.45 |
| | Ti-22A1-13Nb-5Ta-3Mo | 4 h 920° C. | 20 | 1228 | 1254 | 7.45 |
| 11 | Ti-21A1-21Nb | | 20 | 1017 | 1225 | 8.59 |
| | Ti-21A1-21Nb (homogenized) | | 20 | 1002 | 1166 | 2.62 |
| | Ti-21A1-21Nb | | 650 | 718 | 825 | 6.61 |
| | Ti-21A1-21Nb (homogenized) | | 650 | 584 | 699 | 10.9 |
| 12 | Ti-22A1-13Nb-5Ta-3Mo (extruded - annealed) | | 20 | 1303 | 1411 | 2.11 |
| | Ti-22A1-13Nb-5Ta-3Mo (forged - extruded - annealed) | | 20 | 1373 | 1505 | 3.43 |
| | Ti-22A1-13Nb-5Ta-3Mo (extruded - annealed) | | 650 | 1031 | 1111 | 3.51 |
| | Ti-22A1-13Nb-5Ta-3Mo (forged - extruded - annealed) | | 650 | 1081 | 1211 | 2.67 |

Table 2 gives the creep results at 650° C. and 315 MPa, namely the times necessary to obtain a deformation of 0.2% and a deformation of 1%, and the creep rate. Moreover, the creep lifetime at 650° C. and 315 MPa of the alloy after extrusion is 214 hours, whereas it is only 78 hours after forging, i.e. approximately 3 times less, although the creep rates are comparable (Table 2).

TABLE 2

| Ex. | Alloy | Annealing | Stress (MPa) | $t_{0.2\%}$ (h) | $t_{1\%}$ (h) | Rate ($10^{-8}$ $s^{-1}$) |
|---|---|---|---|---|---|---|
| 1 | Ti-22A1-27Nb forged | 4 h 870° C. + 100 h 650° C. | 315 | 2 | 37 | 4.2 |
| | Ti-22A1-27Nb extruded | 4 h 870° C. + 100 h 650° C. | 315 | 3.5 | 36 | 5.5 |
| | Ti-22A1-27Nb | 815° C. + 100 h 760° C. | 315 | 6 | | |
| 2 | Ti-21A1-21Nb | 48 h 800° C. | 200 | 5.5 | 148 | 1.1 |
| 3 | Ti-27A1-21Nb | 48 h 800° C. | 315 | 30 | 695 | 0.35 |
| 4 | Ti-24A1-11Nb-3Mo-1Ta | 48 h 800° C. | 315 | 38 | 1600 | 0.09 |
| 5 | Ti-22A1-11Nb-3Mo-1Ta | 48 h 800° C. | 315 | 2 | 101 | 1.1 |
| 6 | Ti-22A1-13Nb-5Ta-3Mo | 48 h 800° C. | 315 | 11 | 281 | 0.5 |
| 7 | Ti-22A1-13Nb-5Ta-3Mo (extrusion ratio 1:16) | | 315 | 11 | 281 | 0.5 |
| | Ti-22A1-13Nb-5Ta-3Mo (extrusion ratio 1:35) | | 315 | 18 | 402 | 0.45 |
| 8 | Ti-22A1-13Nb-5Ta-3Mo (T of extrusion 1100° C.) | | 315 | 18 | 402 | 0.45 |
| | Ti-22A1-13Nb-5Ta-3Mo (T of extrusion 980° C.) | | 315 | 6 | 151 | 0.9 |
| 9 | Ti-22A1-14Nb-5Ta-2Mo | 48 h 800° C. | 315 | 3 | 85 | 1 |
| | Ti-22A1-13Nb-5Ta-3Mo | 48 h 800° C. | 315 | 18 | 402 | 0.45 |
| | Ti-22A1-12Nb-5Ta-4Mo | 48 h 800° C. | 315 | 8 | 181 | 0.42 |
| 11 | Ti-21A1-21Nb | | 200 | 5.5 | 148 | 1.1 |
| | Ti-21A1-21Nb (homogenized) | | 200 | 1 | 24 | 5 |
| 12 | Ti-22A1-13Nb-5Ta-3Mo (extruded - annealed) | | 315 | 18 | 402 | 0.45 |
| | Ti-22A1-13Nb-5Ta-3Mo (forged - extruded - annealed) | | 315 | 23.5 | | 0.09 |

The third row in Table 1 corresponds to the best ductility result provided by the literature, obtained after a forging+extrusion treatment sequence at 975° C., followed by a solution treatment for 1 hour at 1000° C., by an air hardening and by an annealing for 150 hours at 760° C. The elastic limit at 20° C. is equivalent to that obtained during the present tests. On the other hand, elongation at ambient temperature is of the order of 5%, i.e. half of those obtained during the present tests. However, it should be pointed out that the experimental ingot had an aluminum content lower than the nominal value, approximately 21%, which can partly contribute to the gain in ductility. With respect to creep, the best results in the literature are obtained after a double annealing at 815° C. and at 760° C., the latter temperature being maintained for 100 hours (third row in Table 2).

EXAMPLE 2

In this example, the amount of niobium was reduced to 21% in order to bring the relative density of the alloy into the range of the titanium alloys existing in industry. The alloy with the composition Ti—21Al—21Nb was extruded at a temperature slightly greater than the transus, i.e. 1100° C., with an extrusion ratio of 1:16. The stabilization treatment which was carried out is an annealing for 48 hours at 800° C., it being known that, according to the literature, an annealing for 1 hour is insufficient to stabilize these ternary alloys. In the continuation of the examples, all the test specimens subjected to the tensile and creep tests were subjected beforehand to an annealing for 48 hours at 800° C., except where otherwise indicated. Tables 1 and 2 give respectively the tensile results at 20° C. and 650° C. and the creep results at 650° C. and 200 MPa. In addition, a tensile test at ambient temperature was carried out in the crude extrusion state. It is thus observed that annealing for 48 hours at 800° C. causes a loss of approximately 200 MPa in the elastic limit, whereas the ductility increase from 2.3% to 8.6%. These results of the Ti—21Al—21Nb alloy are entirely comparable with those of the Ti—22Al—27Nb alloy, a fall in strength and in ductility, on the other hand, making itself felt at 650° C. Moreover, the creep results corroborate those of hot tension, in the sense that the lower niobium content tends to reduce the hot properties. This is because, with respect to creep at 650° C. and 200 MPa, 5.5 hours are necessary to reach an elongation of 0.2%, that is to say a time of the same order of magnitude as that obtained for the Ti—22Al—27Nb alloy with a stress greater than the above and equal to 315 MPa.

EXAMPLE 3

With the aim also of decreasing the relative density, the Ti—27Al—21Nb alloy was tested under the conditions indicated in Example 2. The results are also given in Tables 1 and 2. The effect of increasing the aluminum content from 21 to 27% is to considerably reduce the elastic limit at 20° C., of the order of 260 MPa. The loss thus occasioned is 44 MPa on average for each percent of additional aluminum. Likewise, the ductility at 20° C. decreases very markedly when the aluminum content increases from 21 to 27%. The hot tensile properties are also lower for the alloy with the greatest aluminum charge. On the other hand, the latter alloy exhibits markedly higher creep characteristics than the Ti—21Al—21Nb alloy. The cold ductility/creep strength compromise is particularly sensitive to the aluminum content. It is thus necessary to find a balance between these two properties, an acceptable strength/ductility/creep compromise probably being obtained for an intermediate aluminum content, i.e. in the region of 24%.

EXAMPLE 4

In this example, the transformation conditions (extrusion+heat treatment) developed in Examples 1 and 2 were applied, on the one hand, to the Ti—24Al—21Nb alloy and, on the other hand, to a quinary alloy obtained by replacing, in the latter, a portion of the niobium by molybdenum and tantalum. This modification is targeted at reducing the weight of the alloy, not by incorporating a relatively light element, such as vanadium, therein but by replacing a portion of the niobium with molybdenum with maintenance of the β-gen power. This is because, in order to retain comparable microstructures allowing the intrinsic effects of the addition elements to be assessed, 1% Mo is substituted for 3% Nb, given that the ratio of β-gen power between these two elements is 3, from the prior work of the inventors. Furthermore, tantalum, which possesses the same β-gen power as niobium, was added in a small amount in order to improve the hot properties at the expense of a slight sacrifice in the relative density. The Ti—24Al—11Nb—3Mo—1Ta alloy is thus compared with the Ti—24Al—21Nb alloy. On account of its content of niobium equivalent, the quinary alloy still belongs to the category of $Ti_2AlNb$ alloys, despite its relatively low niobium content. It can also be compared with the $\alpha_2$ alloy mentioned above, from which it differs by the addition of molybdenum and of tantalum.

The results given in Tables 1 and 2 for the Ti—24Al—21Nb alloy are calculated by interpolation from those corresponding to the Ti—21Al—21Nb and Ti—27Al—21Nb alloys, by assuming that the values vary linearly as a function of the aluminum content. Under these conditions, the gain in strength at 20° C. of the quinary alloy is considerable and greater than 400 MPa in comparison with the ternary alloy. The ductility is, on the other hand, lower but remains very acceptable with an elongation of 1.9% at ambient temperature. With respect to hot tension, the gain in elastic limit remains identical. Thus, the elastic limit at 650° C. is even greater than that obtained at 20° C. for the known alloys, such as the Super $\alpha_2$ alloy. However, the ductility at 650° C. falls to 1%. It could probably be improved by an optimization of the annealing treatment for this alloy. In Table 2, only the creep results of the quinary alloy at 650° C. and 315 MPa are given, which results reveal remarkable characteristics, far beyond any result known for the alloys of the $Ti_3Al$ and $Ti_2AlNb$ categories. This is because an elongation of 0.2% is obtained after 38 hours, against 6 hours in the case of the Ti—22Al—27Nb alloy. Moreover, the secondary creep rate is very low and equal to $9\times10^{-10}$ $s^{-1}$. Finally, it is important to point out that the relative density of 4.8 for this alloy is extremely attractive, since it is scarcely greater than that of the Super $\alpha_2$ alloy (4.6) and lower by 9% in comparison with that of the Ti—22Al—27Nb alloy.

These creep results are highly revealing of the sensitivity of this property to the presence of the elements molybdenum and tantalum. Currently, it seems that a fraction ranging up to 12% niobium can be replaced by molybdenum and tantalum. The limitation in this respect is illustrated by the Ti—24Al—4Nb—4Mo—1Ta alloy, which is characterized by a very high cold shortness and a mediocre hot strength. Moreover, it is impossible to use alloys containing an excessively high proportion of refractory elements Ta and Mo relative to niobium. For example, alloys such as Ti—24Al—15Nb—10Mo are brittle after extrusion and annealing and are thus useless in the present context.

EXAMPLE 5

In this example, an attempt has been made to increase the ductility of the quinary alloy, at the expense of a slight sacrifice in the creep behavior, by returning the aluminum content to 22%. The results given in Tables 1 and 2 show that the ductility is substantially improved at 650° C. with an elongation of 2.5% but to the detriment of the creep characteristics, which prove to be much lower, since an elongation of 0.2% is already achieved after 2 hours. This result indicates that the aluminum content is extremely critical in obtaining a good compromise in properties.

EXAMPLE 6

In order to improve the compromise in mechanical properties of the quinary alloy, some adjustments in composition were carried out. The addition of the β-gen elements was increased, in particular tantalum, in order to maintain the favorable high temperature properties, to the detriment of the relative density, and the aluminum content was decreased in order to favor the ductility. An alloy with the composition Ti—22Al—13Nb—5Ta—3Mo was extruded and annealed under the same conditions as the preceding alloys. The mechanical properties of this alloy offer the best compromise in properties to date, with in particular, at ambient temperature, an elastic limit of close to 1300 MPa and a ductility of 3.7%. The hot properties are also very promising with, with respect to creep at 650° C. and 315 MPa, a time of 11 hours to reach an elongation of 0.2%, which is better than the result with the Ti—22Al—27Nb alloy.

EXAMPLE 7

In this example, three different extrusion ratios of between 5 and 35 were experimented with on the same Ti—22Al—13Nb—5Ta—3Mo alloy, for the same extrusion temperature of 1100° C. and the same annealing. It turns out that the elastic limit at 20° C. is relatively insensitive to the extrusion ratio, the ductility being in all cases greater than 2% (Table 1). In the light of the creep results (Table 2), the highest extrusion ratio appears to give the best performance, with a time of 18 hours to reach an elongation of 0.2% for the same conditions 65° C. and 315 MPa. Moreover, it is important to point out that, while the extrusion ratio of 1:5 proves to be sufficient in the case of a small ingot in obtaining a good level of ductility, it is, on the other hand, probable that an ingot of larger size, and thus with a coarser structure, requires a higher extrusion ratio.

EXAMPLE 8

This time it is the extrusion temperature which is varied (1100 and 980° C.), for the same alloy as above and with the ratio 1:35. The elastic limit at 20 and 650° C. is not affected by the extrusion temperature, the cold ductility being, on the other hand, greater after extrusion at 980° C. Moreover, a decrease by a factor of 2 in the minimum creep rate is obtained when the extrusion temperature becomes greater than the transus temperature. The extrusion temperature is thus necessarily greater than the transus temperature or at least in its immediate vicinity, if it is desired to give priority to optimizing the creep strength.

EXAMPLE 9

With the aim of optimizing the composition of the alloy, three alloys with respective compositions Ti—22Al—12Nb—5Ta—4Mo, Ti—22Al—13Nb—5Ta—3Mo and Ti—22Al—14Nb—5Ta—2Mo and with a slightly different β-gen power were compared, the extrusion being carried out at 1100° C. with the ratio 1:35. In the results of the tensile tests at 20° C., the decrease in the molybdenum content is reflected by a slight fall in elastic limit, in particular between 3 and 2% Mo. At 650° C., a slight fall in the elastic limit is also observed, which is accompanied this time by a substantial increase in the elongations. The best strength/ductility compromise is thus obtained for 3% Mo. With respect to creep at 650° C. and 315 MPa, the alloy containing 3% Mo also shows the best performance and consequently constitutes the preferred alloy.

EXAMPLE 10

In order to obtain a good balance between the tensile strength and the ductility, it is necessary to subject the alloys to a heat treatment which can precipitate the second phase in given proportions. For example, this is obtained with the Ti—22Al—13Nb—5Ta—3Mo alloy by heating at a temperature of between 800° C. and 920° C. Although it is possible to treat these alloys at higher temperatures, this is not recommended because the benefit of the strong bonding achieved by extrusion would then be lost. In addition, these annealing treatments at relatively low temperature do not require a critical cooling rate, which is advantageous from a practical and industrial viewpoint. By way of example, the tensile results at ambient temperature for a few heat treatments are collated in Table 1. Thus, the annealing temperature and time parameters make it possible to modulate the elastic limit level as a function of the minimum level of elongation required.

EXAMPLE 11

This examples shows the harmful influence of a homogenization heat treatment before extrusion. It is not a matter here of excluding any treatment targeted at obtaining a cast structure which is homogeneous on a macroscopic scale. Rather it concerns preserving the existence of chemical concentration gradients on a microscopic scale which makes it possible to increase both the strength of the alloy and its ductility. This relative local chemical nonhomogeneity is then reflected after extrusion by a structure composed of hard regions and of soft regions intermeshed with one another. The influence of a homogenization heat treatment for 50 hours at 1450° C. under high vacuum was determined on the two alloys Ti—21Al—21Nb and Ti—22Al—13Nb—5Ta—3Mo. The latter were subsequently extruded at 1100° C. with an extrusion ratio of 1:16 and then treated for 48 hours at 800° C. in order to compare them with the two alloys which had not been subjected to any homogenization treatment. The results, collated in the Tables, reveal the very great influence of this homogenization treatment on the mechanical properties of the Ti—21Al—21Nb alloy. This prior treatment causes, after extrusion and annealing, a very large fall in ductility at 20° C. from 8.6% to 2.6%. It also occasions a greater loss in elastic limit between 20 and 650° C. Finally, this treatment has a harmful effect on the creep, since the creep rate is five times higher. The most spectacular influence of this prior treatment is observed with the Ti—22Al—13Nb—5Ta—3Mo alloy, since it causes premature fracture of the alloy well before reaching the tensile elastic limit threshold at 20° C.

EXAMPLE 12

The extrusion transformation sequence is unique in the sense that is alone possesses the advantage of retaining good ductility for alloys containing substantial amounts of other refractory elements than niobium, such as molybdenum or tantalum. However, this extrusion transformation sequence can be advantageously combined with an isothermal forging sequence for the production of large turbomachine components. This is because an isothermal forging carried out before extrusion proves to be beneficial for the subsequent mechanical properties because the structure is improved during the prior forging. In this instance, the latter was carried out at a temperature of 980° C. with a degree of reduction of 75%. The results of the tensile and creep tests which appear in the Tables, which compare a forging+extrusion+annealing sequence and an extrusion+annealing sequence, reveal that it is possible to further increase the strength of the alloy without loss in ductility. However, the slightly higher aluminum content (23% Al) of the preforged alloy can partly explain the gain obtained in the creep strength; on the other hand, it cannot account for the gain in ductility, an increase in the aluminum content being known to be favorable to the creep strength and unfavorable to the ductility.

The novel $Ti_2AlX$ alloys possess ductilities which make them fully machineable with the standard processes used for titanium. One of the noteworthy results of these novel alloys relates to the good reproducibility of the elongations at break, no test specimen tested ever having displayed brittle fracture. The novel alloys also have strength to relative density ratios which put them in competition not only with the preceding alloys of the $Ti_2AlNb$ type but also with titanium alloys, such as the IMI834 alloy, or nickel alloys, such as the INCO718 (or IN718) alloy.

In order to better understand the advantage of the alloys according to the invention, reference is made to the drawings.

Figure 1:
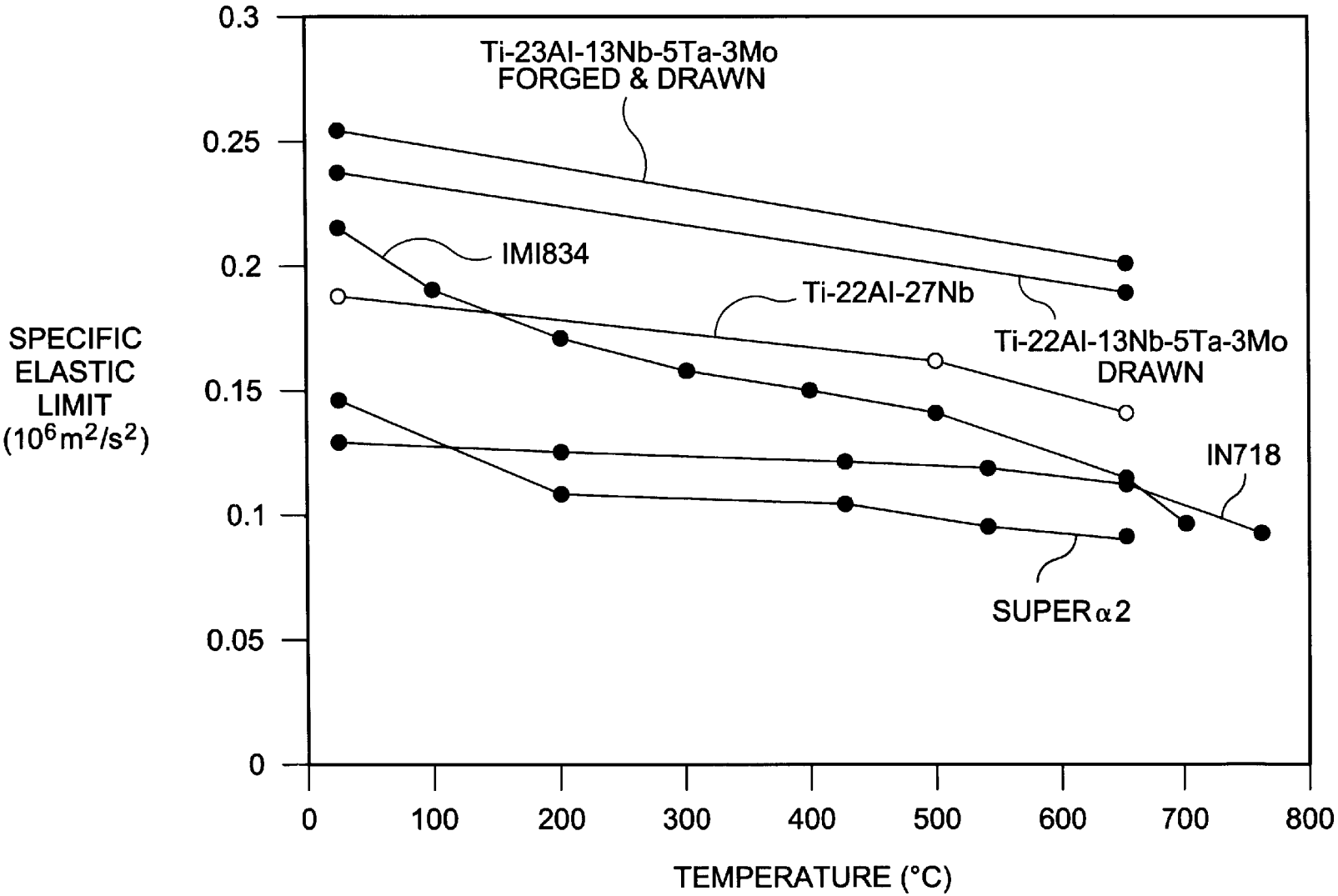
FIG. 1 represents the elastic limit corrected by the relative density as a function of the test temperature for various alloys. With reference to this figure, it appears that the alloys of the invention introduce a marked improvement in the elastic limit/relative density ratio, of the order of 25% at 20° C. and of 50% at 650° C., in comparison with the titanium alloys of $Ti_2AlNb$ or IMI834type.
Figure 2:
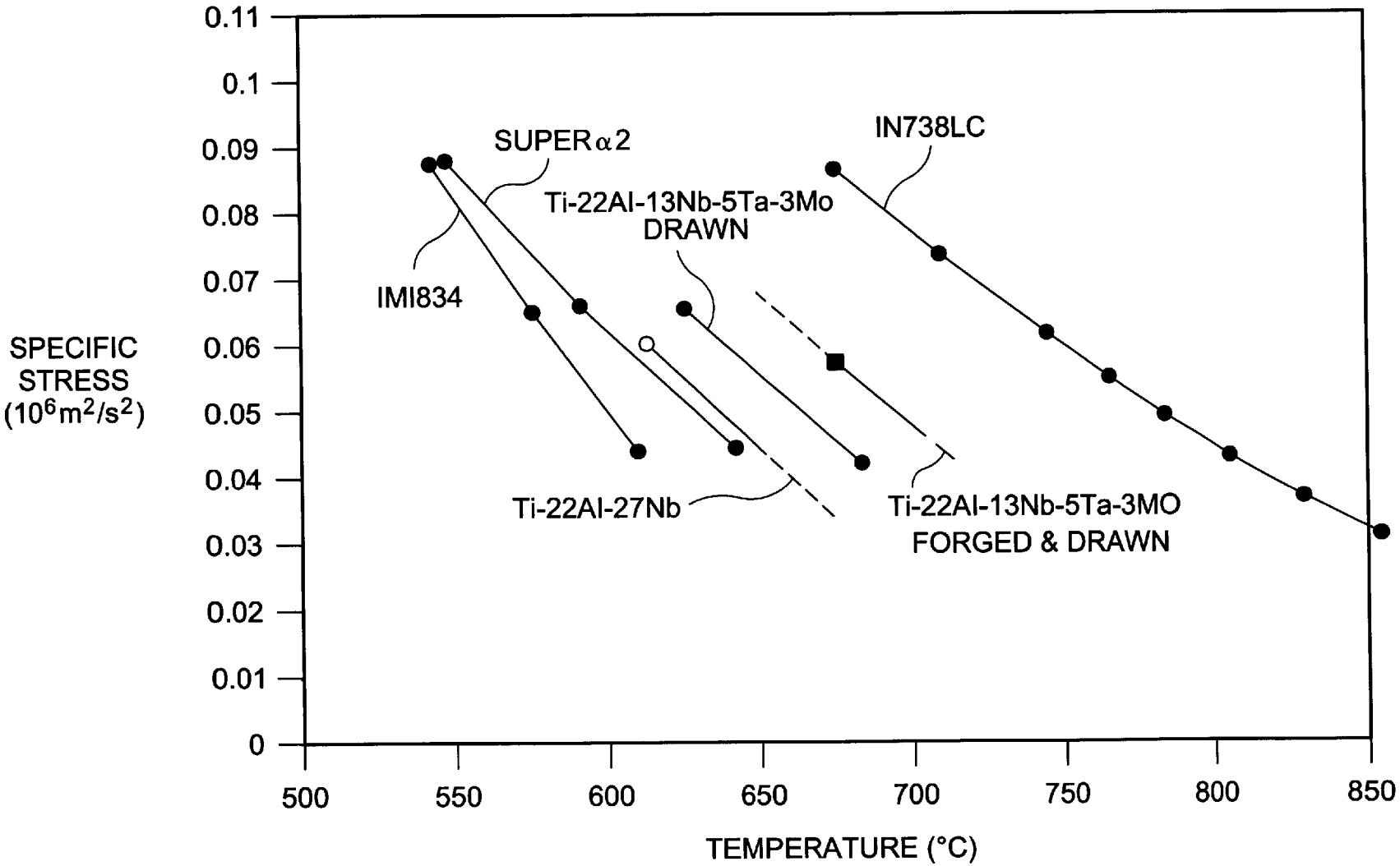
FIG. 2 represents the creep stress corrected by the relative density as a function of the test temperature, on the basis of an elongation of 0.5% over 100 hours, for various alloys. With reference to this figure, the alloys of the invention offer a very appreciable gain in temperature, of the order of 70° C., in comparison with the IMI834 alloy or with the Super $\alpha_2$ alloy.

Given that molybdenum and tantalum are elements which increase the relative density, the sum Mo+Ta should be maintained at less than 9%. It should be greater than 3% in order to obtain a beneficial effect on the hot properties. Moreover, the concentrations of niobium equivalent should be, for the novel alloys, between 21 and 29%, that is to say 25±4%. The niobium equivalent is not the only criterion to be taken into consideration in defining the advantageous range of compositions. This is because excessively high molybdenum contents (Ti—24Al-15Nb-10Mo alloy) or excessively low niobium contents (Ti-24Al-4Nb-4Mo-1Ta alloy) result in high brittleness and are thus not of particular advantage. Consequently, the niobium contents should be greater than 10%.

What is claimed is:

1. A $Ti_2AlX$ alloy composed at least essentially of the elements Ti, Al, Nb, Ta and Mo wherein the relative amounts as atoms of said elements and of silicon are within the following intervals:

| | |
|---|---|
| Al: approximately | 20 to approximately 25% |
| Nb: approximately | 10 to approximately 14% |
| Ta: approximately | 1.4 to approximately 5% |

-continued

| | |
|---|---|
| Mo: approximately | 2 to approximately 4% |
| Si: | 0 to approximately 0.5% |
| Ti: | remainder to 100%. |

2. An alloy according to claim 1, wherein said alloy contains 21 to 32% of niobium equivalent as atoms.

3. An alloy according to claim 1 wherein said relative amounts are within the following intervals:

| | | | | | |
|---|---|---|---|---|---|
| Al: | approximately | 21 | to | approximately | 23% |
| Nb: | approximately | 12 | to | approximately | 14% |
| Ta: | approximately | 4 | to | approximately | 5% |
| Mo: | | | | approximately | 3% |
| Ti: | remainder to 100%. | | | | |

4. An alloy according to claim 3, wherein said relative amounts are as follows:

| | | |
|---|---|---|
| Al: | approximately | 22% |
| Nb: | approximately | 13% |
| Ta: | approximately | 5% |
| Mo: | approximately | 3% |
| Ti: | approximately | 57%. |

5. Process for the transformation of an alloy according to claim 1, comprising an extrusion treatment at a temperature suitable for the production of a creep-resistant single-phase structure, followed by an annealing for at least four hours in the interval from 800 to 920° C., in order to produce a stable $\beta_0$+O two-phase structure favorable to the ductility.

6. Process according to claim 5, characterized in that the extrusion treatment is preceded by an isothermal forging treatment at a temperature below the β-transus temperature of the alloy.

7. A turbomachine component made from an alloy transformed by a process comprising an extrusion treatment at a temperature suitable for the production of a creep-resistant single-phase structure, followed by an annealing for at least four hours in an interval from 880 to 920° C., in order to produce a stable $\beta_0$+O two-phase structure favorable to ductility;

wherein said alloy is a $Ti_2AlX$ alloy composed at least essentially of the elements Ti, Al, Nb, Ta and Mo wherein the relative amounts as atoms of said elements and of silicon are within the following intervals:

| | |
|---|---|
| Al: approximately | 20 to approximately 25% |
| Nb: approximately | 10 to approximately 14% |
| Ta: approximately | 1.4 to approximately 5% |
| Mo: approximately | 2 to approximately 4% |
| Si: | 0 to approximately 0.5% |
| Ti: | remainder to 100%. |

* * * * *

UNITED STATES PATENT AND TRADEMARK OFFICE

CERTIFICATE OF CORRECTION

PATENT NO. : 6,176,949 B1
DATED : January 23, 2001
INVENTOR(S) : Thomas, et al.

It is certified that error appears in the above-identified patent and that said Letters Patent is hereby corrected as shown below:

Abstract,
Line 2, in chart, now reads "Nb: 10 to 15%", should read -- Nb: 10 to 14% --.

Column 11,
Line 29, now reads "or IMI834type", should read -- or IMI834 type --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*